US010100514B2

(12) United States Patent
Klein et al.

(10) Patent No.: US 10,100,514 B2
(45) Date of Patent: Oct. 16, 2018

(54) JOINT-SEALING TAPE AND SEALING ARRANGEMENT WITH SUCH SEALING TAPE

(71) Applicant: Hilti Aktiengesellschaft, Schaan (LI)

(72) Inventors: Manfred Klein, Kaufering (DE); Christian Foerg, Lamerdingen (DE); Markus Koegler, Buchloe (DE); Bernd Grosse, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/548,678

(22) PCT Filed: Feb. 12, 2016

(86) PCT No.: PCT/EP2016/052981
§ 371 (c)(1),
(2) Date: Aug. 3, 2017

(87) PCT Pub. No.: WO2016/128536
PCT Pub. Date: Aug. 18, 2016

(65) Prior Publication Data
US 2018/0030727 A1 Feb. 1, 2018

(30) Foreign Application Priority Data
Feb. 13, 2015 (EP) ..... 15155101

(51) Int. Cl.
*E04B 1/94* (2006.01)
*E04B 2/74* (2006.01)
(Continued)

(52) U.S. Cl.
CPC ..... *E04B 2/7409* (2013.01); *E04B 1/68* (2013.01); *E04B 2/82* (2013.01)

(58) Field of Classification Search
CPC ..... E04B 2/7411; E04B 1/948; E04B 2/7457; E04B 1/947; E04B 1/6812; B05B 12/24; Y10T 428/28
See application file for complete search history.

(56) References Cited

U.S. PATENT DOCUMENTS 4,509,999 A * 4/1985 Sandor ..... E06B 7/231 156/71
4,663,204 A * 5/1987 Langham ..... B32B 3/30 428/12

(Continued)

FOREIGN PATENT DOCUMENTS

DE 25 31 543 A1 2/1977
WO 2001/71123 9/2001

OTHER PUBLICATIONS

International Search Report dated Apr. 13, 2016 in PCT/EP2016/052981 filed Feb. 12, 2016.

*Primary Examiner* — Brian D Mattei
*Assistant Examiner* — Daniel J Kenny
(74) *Attorney, Agent, or Firm* — Grüneberg and Myers PLLC

(57) ABSTRACT

The present invention relates to a joint-sealing tape with an elongated carrier and at least two separate sealing elements of predetermined width, which are disposed on one side of the carrier, spaced apart, side-by-side and running in the longitudinal direction of the carrier, and which each have two oppositely disposed broad sides as well as two narrow sides running transversely relative to the broad sides and connecting them, wherein the sealing elements are disposed with one broad side on the carrier, wherein the sealing elements are each joined firmly to the carrier only via part of their broad side.

(Continued)

Furthermore, the invention relates to a sealing arrangement for sealing of building structure joints, especially for sealing against sound and/or smoke and if applicable against fire, with such a sealing tape.

14 Claims, 6 Drawing Sheets

(51) Int. Cl.
*E04B 2/82* (2006.01)
*E04B 1/68* (2006.01)

(56) References Cited

U.S. PATENT DOCUMENTS 5,091,235 A * 2/1992 Vergnano ..... B32B 5/26 428/192
6,086,709 A * 7/2000 Hills ..... B05B 12/265 156/293
6,256,956 B1 * 7/2001 Davis ..... E06B 1/62 277/645
8,353,139 B2 * 1/2013 Pilz ..... E04B 1/948 52/232
8,541,084 B2 * 9/2013 Deiss ..... E04B 1/6809 428/119
8,551,594 B2 * 10/2013 Deiss ..... E04B 1/6812 428/131
8,555,566 B2 * 10/2013 Pilz ..... E04B 2/828 52/167.1
8,733,019 B2 * 5/2014 Vulpitta ..... E06B 7/2316 49/70
9,021,754 B2 * 5/2015 Wormann ..... E04B 1/6812 52/214
2013/0031856 A1 2/2013 Pilz et al.
2013/0330492 A1 * 12/2013 Rogers ..... B32B 3/26 428/40.1
2015/0013254 A1 1/2015 Pilz et al.
2016/0228826 A1 * 8/2016 Furuuchi ..... H05K 5/06

* cited by examiner

JOINT-SEALING TAPE AND SEALING ARRANGEMENT WITH SUCH SEALING TAPE

The present invention relates to a joint-sealing tape as well as a sealing arrangement with such sealing tape for sealing of building structure joints, especially for sealing against sound and smoke and if applicable against fire.

In particular, the invention relates to acoustic, smokeproof and/or fireproof sealing of connecting joints in drywalls, especially of expansion joints. These are found in the region of connection to the inter-story ceiling, to the floor and to massive walls. Due to weight loading or thermal influences, the ceiling in buildings may be forced upward or downward. To prevent damage to the drywall, the upper connecting joint in this case is made as an expansion joint. The ceiling profile is made in such a way that a relative movement between ceiling profile and the vertical wall components is possible.

In general, a channel profile constituting part of the studwork is fastened to the connecting building parts. The gypsum boards themselves are attached at a well-defined spacing to the connecting building part. Usually sealing of the system is provided in the gap between gypsum board and ceiling. For this purpose, either a suitable sealing compound is introduced or else the gap is filled with mineral wool and provided at the surface with a sealing layer. In both cases, the material present in the joint presents relatively strong resistance to movement, with the consequence that comparatively large joint widths are necessary in order to achieve adequate movement absorption.

In particular, sealing of the gap with sealing compound has some disadvantages. It is particularly laborious, and in the course of time the sealing tends to crack when overloaded. Furthermore, sealing can be performed only after the gypsum boards have been mounted, and it requires access to the finished drywall from both sides. Furthermore, this procedure is error-prone, since the user himself or herself must dose the correct quantity of material in order to seal the gap adequately. Above and beyond this, the drywall builder must make the width of the joint correspond to the material and expansion properties of the sealing compound. During installation of the sealing compound, nothing but the joint can be filled. During expansion of the gap, it must be ensured that the sealing compound adheres sufficiently strongly to the underlying surface and that it is able to absorb the tensile forces that develop. Frequently this not the case, and the danger exists that the sealing compound will become detached from the underlying surface or that the sealing compound itself will be overloaded and tear. In the case of a narrower gap, the sealing compound can be compressed to only a limited extent, because of its material properties, and the danger exists that it will be forced out of the gap if the joint is incorrectly dimensioned. Due to the limited expansion and compression capability of the sealing compound (max. +/−25%), it is very important to ensure adequately large dimensioning of the spacing between gypsum board and ceiling. This is frequently underestimated, and so adequate imperviousness often cannot be guaranteed during use of customary sealing compounds.

Some further approaches exist for sealing of joints, especially joint cords or joint sprays, which to some extent suffer from the same disadvantages as have been described for sealing compounds.

The object of the invention is to provide a joint-sealing tape that avoids the disadvantages of the known materials, that in particular is easier and safer to use, simplifies the mounting of further building parts and ensures good sealing as soon as it is applied.

A further object of the invention is to provide an arrangement that, in the event of fire, permits better sealing of the joint between two building parts, especially between a drywall and a connecting building part, such as a wall, a ceiling or a floor, and thus provides better and durable sealing against sound and/or smoke and if necessary better and durable fire protection, and can be mounted reliably and free of defects with little work effort. Furthermore, the invention makes it possible, by appropriate choice of the sealing materials, to adjust the proper spacing of gypsum boards relative to the connecting building part, especially relative to the floor, without additional auxiliary means.

According to the invention, a joint-sealing tape is provided for sealing a joint between a first building part and a second building part, with an elongated carrier and at least two separate compressible sealing elements of predetermined width, which are disposed on one side of the carrier, spaced apart, side-by-side and running in the longitudinal direction of the carrier, and which each have two oppositely disposed broad sides as well as two narrow sides running transversely relative to the broad sides and connecting them, wherein the sealing elements are disposed with one broad side on the carrier, which tape is characterized in that the sealing elements are each joined firmly to the carrier only via part of their broad side.

With the inventive joint-sealing tape, irregularities of the surface of a building part can be safely sealed as soon as one building part is disposed on another building part, since the sealing elements of the joint-sealing tape are pressed sufficiently firmly against the surface of the one building part and at the same time against the side faces of the other building part.

Preferably, the part of the sealing element that is joined firmly to the carrier forms an outer region, and the part that is not joined firmly to the carrier forms an inner region, wherein the respective inner regions of the sealing element are facing one another but are disposed spaced apart from one another. Hereby it is achieved that, when the joint-sealing tape is pushed onto a building part with channel-shaped outer profile, such as a channel profile of a drywall studwork, for example, the inner ends of the sealing elements become upright and extend beyond the channel profile with an exactly defined projecting length. When one building part is disposed on a connecting building part, this projecting length is squeezed together due to the compressible sealing elements and thereby closes any irregularities that may be present. Furthermore, a torque is generated in the sealing elements and presses them in the direction of the building part on which the joint-sealing tape was applied, so that it also presses sealingly on that building part.

The carrier has three regions, namely two regions on which the sealing elements are disposed, and which form the two outer regions, and one region between, which forms the middle region. The parts of these two outer regions of the carrier, on which the sealing elements are not firmly joined to the carrier, respectively adjoin the middle region of the carrier and together therewith form a support region for application on a building part with channel-shaped outer profile.

Preferably, the sealing elements are configured as strips and form a sealing strip. In one possible preferred embodiment, the sealing elements, especially sealing strips, have a rectangular cross section. However, other or mixed cross-sectional shapes are also conceivable and possible. In one possible alternative embodiment, the outer region and the inner region of a sealing element are not separated from one another, so that the sealing element is configured in one piece. In alternative embodiments, the outer region and the inner region of a sealing element may define separate regions of the sealing element, which have different cross sections and/or may consist of different materials.

For example, each outer region of the sealing tapes has a rectangular or square cross section. Each inner region of the sealing tapes may have, for example, a rectangular, square, triangular or semicircular cross section.

The dimensions both of the sealing elements and of the carrier are chosen to correspond to the planned use of the joint-sealing tape.

The carrier of the joint-sealing tape may consist of a film, for example of a plastic film, of a fabric, especially of a noncombustible material, such as inorganic fibers, for example glass fibers, a nonwoven or the like.

According to the invention, the sealing elements consist of a deformable material. This material may be either plastically or elastically deformable. "Deformable" means that irregularities in the building part, against which the sealing elements are pressed, can be evened out. In this connection, "plastically deformable" means that the sealing elements are deformable and no longer return to their original shape after deformation. Analogously, "elastically deformable" means that the sealing elements are deformable and return to their original shape after deformation, i.e. the material can be deformed reversibly to a certain extent. In particular, the sealing elements consist at least partly, preferably completely of a material that is resilient after compression, for example such as foam, sponge rubber, cellular rubber or the like. The inventive sealing elements preferably consist of a soft foam that is resilient after compression. Common foams such as polyethylene and polyurethane foams or cellular rubber can be mentioned as foam material. This foam may be an open-celled foam with very low air passage resistance, or else an approximately closed-celled foam with extremely low air permeability values. Even foams with air permeability values lying between the two extreme cases mentioned in the foregoing may be used within the scope of the present invention. The foam may be impregnated with an impregnating agent that increases the sealing properties of the foam. In order to achieve imperviousness to smoke, at least the outer surface of the sealing element must be of closed-pore nature. Alternatively, the sealing element may be an open-celled material, which is provided with a cover layer or jacket, for example of a film, especially plastic film. The cover layer or the jacket may be formed by the carrier or by a separate material.

It has proved advantageous when the sealing elements consist of a slow-burning foam, such a cellular rubber or polyurethane foam, for example. In the case of a slow-burning foam, there is no possibility that fire will be propagated by the foam. Spontaneous inflammation is ruled out by the above-mentioned foam-type starting materials. It is also advantageous that no dripping occurs in the event of fire. A slow-burning foam should still have at least 20%, still at least 25%, preferably still at least 30%, between 20% and 60%, between 20% and 40%, preferably between 25% and 30% of its initial volume in a temperature range between 500° C. and 800° C.

Furthermore, a slow-burning foam should still have at least 10%, at least 20%, preferably still at least 30%, between 10% and 40%, between 10% and 30%, preferably between 15% and 20% of its initial mass in a temperature range between 500° C. and 800° C.

Furthermore, the material may contain appropriate additives if fire protection properties such as intumescence, for example, are desired. In this connection, "intumescence" means that, under the effect of heat, such as in the event of fire, the material swells and forms an insulating layer of flame-retardant material. The formation of a voluminous insulating layer, namely an ash layer, may take place due to the chemical reaction of a mixture of compounds that are appropriately matched to one another and that react with one another under the effect of heat. Such systems are known to the person skilled in the art as chemical intumescence, and they may be used according to the invention. Alternatively, the voluminous insulating layer may be formed by swelling of an individual compound, which releases gases under the effect of heat, even though no chemical reaction has occurred between two compounds. Such systems are known to the person skilled in the art as physical intumescence, and they may also be used according to the invention. According to the invention, the two systems may be used respectively alone or together as a combination.

In some embodiments, it is even sufficient when the carrier alone is impervious to smoke and/or gases.

It must be ensured that, after installation of the joint-sealing tape, this seals the building-structure joint against the penetration of sound, smoke, gases and/or fire, depending on which property is desired or required.

The sealing elements may consist of one piece made from one material or of multiple parts made from several materials and, for example, may exist as a layered body.

The positioning of the sealing elements on the connecting element may be achieved by fastening means, for example in the form of an adhesive layer, especially a self-adhesive layer, or with a double-sided adhesive, in the form of interlocking or frictionally acting means, such as suitable profiled shapes, or by means of welding, such as thermal welding, for example, or ultrasonic welding, or the like. Positioning of the sealing elements on the connecting element by means of an adhesive layer or welding is preferred. For one-piece joint-sealing tapes, the positioning is predetermined by manufacturing factors.

In turn, the carrier for the sealing elements may have means for fastening to a building part, such as a drywall profile, for example in the form of a self-adhesive layer, in the form of interlocking or frictionally acting means, such as suitable profiled shapes or the like.

The inventive joint-sealing tape is particularly suitable for safely sealing a building-structure joint between two adjacent building parts in simple manner, especially against sound and/or smoke and if necessary also against fire. To ensure that the joint-sealing tape can fulfill its function, the regions with which the two building parts are adjacent to one another must be of different widths.

Accordingly, a further subject matter of the invention is a sealing arrangement for sealing, a joint between two juxtaposed building parts, with at least one first building part, one second building part and the joint-sealing tape described in the foregoing, wherein the side with which the second building part bears on the first building part has a face (F2) with a width (B2) and the first building part has a face (F1) with a width (B1), on which the second building part bears, with the condition that the width (B2) is smaller than the width (B1). The sealing arrangement is characterized in that the sealing elements are positioned in the outer region of the joint and are configured to seal the joint from outside. In this connection, "positioned in the outer region of the joint" means that these sealing elements are disposed on the second building part, especially laterally.

According to the invention, the application of the joint-sealing tape on the face (F2) of the second building part and its arrangement on the first building part is facilitated, since the two sealing elements are respectively joined firmly to the carrier only over part of their broad side. This is achieved particularly advantageously when the sealing elements are joined to the carrier only at the respective outer rim regions of the joint-sealing tape. Thus the parts of the carrier on which the sealing elements are disposed but not joined firmly to the carrier respectively adjoin the middle region of the joint-sealing tape and together therewith form a support region. During installation of the joint-sealing tape, this support region comes into contact with the face (F2) of the second building part, in such a way that the width of the support region corresponds to the width (B2) of the second building part. In the process, the carrier is disposed on the building part with the side opposite the sealing tapes.

After application of the joint-sealing tape on the second building part, the sealing elements wrap around and are applied on opposite faces, which are joined by the face (F2), so that the sealing elements have a projecting length (h) relative to the face (F2) of the first building part. The projecting length (h) points in the direction of the face (F1) of the first building part. The narrow sides, facing one another, of the sealing elements are then applied on the first building part, especially sealingly.

So that, in a particularly preferred embodiment of the joint-sealing tape, in which the sealing elements are configured as rectangular sealing strips, sealing relative to the first building part can be guaranteed solely by disposing the second building part on the first building part and thus applying pressure to the sealing elements, the following condition must be fulfilled: for predetermined width (c) of the broad side of the sealing elements and if necessary for predetermined width (B2) of the face (F2) of the second building part (herein also denoted as width (p)), the width (a) of the outer region of the sealing elements is chosen as a function of the width (p) in such a way that the width (b) of the support region of the carrier corresponds to at least the width (p) ($b \geq p$) and the width (t) of the middle region of the joint-sealing tape is smaller than the width (p) ($t < p$).

The size of the projecting length (h) or the dimensioning of the joint-sealing tape may then be calculated simply on the basis of the following formula, where b is chosen in such a way that b corresponds to at least p and t is smaller than p:

$$\text{Projecting length } h = (c - a) - \frac{(b - p)}{2}$$

If at constant (c-a) the width (b) becomes greater than the width (p) of the second building part, the resulting projecting length (h) decreases, since the sealing elements slip further apart from one another and, on the second building part, therefore slip away from the face (F2).

According to the invention, the joint-sealing tape may be used on all kinds of connecting joints where one building part encounters another building part, provided the faces with which the two building parts abut one another are of different sizes. Accordingly, the joint-sealing tape may be used on all profiles, even closed profiles or wooden beams, which must be sealed to a connecting face.

In a particularly preferred embodiment of the sealing arrangement, the first building part is a wall, a ceiling or a floor of a building structure and the second building part is a frame profile of a drywall studwork, for example a channel profile.

The invention will be described in more detail hereinafter on the basis of the application of the joint-sealing tape on a channel profile of a drywall studwork, without hereby restricting the scope of protection. The person skilled in the art is aware that application to any correspondingly styled building-structure joints is possible without any or without large adaptations of the joint-sealing tape.

A connecting joint, above all in dry construction, can be sealed particularly effectively when at least two further building parts are provided that are disposed laterally on a second building part. In this case, one further building part is disposed on one side and the second further building part is disposed on the opposite side of the second building part, each being spaced apart from the first building part. Thereby a joint bounded by the three building parts is formed.

A particularly preferred use of the joint-sealing tape therefore relates to the sealing of profiles in dry construction, wherein the first building part is a floor, a ceiling or a wall of a building element, for example a masonry structure or concrete building element, and the second building part is a ceiling, floor or wall profile or a metal or wood studwork of a dry construction element. The profile may be any of the profiles commonly used for dry construction, regardless of whether it has a slotted or non-slotted web or slotted or non-slotted flange. The further building parts are gypsum boards, which bear closely on the profiles and are fastened to the studwork. In order to permit vertical movement of the gypsum boards, for example in the event of an earthquake, the gypsum boards are mounted to be vertically movable at a spacing from a wall, a floor or a ceiling. Thereby a space (also referred to as joint herein) is formed between the gypsum board and the wall, the floor or the ceiling. This joint is filled by the sealing element of the joint-sealing tape, so that the sealing element seals the joint against sound and/or smoke and, depending on material of the sealing element, also against fire if necessary.

As already described, the joint-sealing tape has an elongated carrier and at least two separate sealing elements of predetermined width, which are disposed on one side of the carrier, spaced apart, side-by-side and running in the longitudinal direction of the carrier. In this connection, the shape of the sealing elements or their cross-sectional shape is not restricted as long as the sealing elements, after installation of the joint-sealing tape, adjoin the two building parts and are able to close the joint that exists between the building parts.

In a preferred embodiment, the sealing elements are configured as sealing strips and have a rectangular cross section, wherein each of the sealing strips has two opposite broad sides as well as respectively two narrow sides running transversely relative to the broad sides and connecting them, and wherein respectively one broad side is provided for application on the second building part and respectively one of the narrow sides is provided for application on the first building part.

In general, the width of the sealing strips will be chosen as a function of the profiles being used and of the material being used. The width must be chosen such that the sealing strip fills the gap between the gypsum board and the ceiling and bears sealingly both on the ceiling and on the gypsum board. If a vertical movement of the gypsum boards is to be permitted, the sealing strip must follow the movement of the gypsum board, so that the contact with the gypsum board is not torn apart and no gaps are able to form between sealing strip and gypsum board. For this purpose, the sealing strip preferably consists of resilient and compressible material and is appropriately precompressed during mounting of the gypsum board, so that a downward movement of the gypsum board, whereby the gap between this and the ceiling becomes larger, can be followed. In this way, the preadjusted freedom of movement of the gypsum board determines the width of the sealing strip.

The height of the narrow side of the sealing strip is chosen as a function of the desired application of the sealing strip, in which case the height for a single-boarded arrangement will be chosen as approximately the thickness of one gypsum board and the height for a double-boarded arrangement will be chosen as approximately twice the thickness of one gypsum board. In the case of a single-boarded arrangement, however, it is also possible to use the joint-sealing tape designed for a double-boarded arrangement.

As an example, the material of the sealing element may be chosen in such a way that its hardness or compressibility is adjusted such that the sealing strip is compressed to a well-defined height merely by the dead weight of the gypsum board in the floor region, for example by constructing the sealing element as two layers of foam materials with different compression density. In this way a correct spacing between floor and gypsum board can be adjusted without further measurement. This is necessary in particular whenever damage to the gypsum board by rising dampness must be prevented.

Preferably the joint-sealing tape is subdivided into three regions, in which case the regions on which the sealing strips are disposed form the two outer regions. The region between them forms the middle region, and in particular the middle region will be formed by the region between the narrow sides, facing one another, of the two sealing strips. Thus the middle region consists only of the carrier. In this embodiment, the installation and especially the positioning of the joint-sealing tape on the web of the channel profile is facilitated.

A better hold of the sealing strips on the flanges of the channel profile, and better, especially tighter pressing of the sealing strips on the ceiling, so that the sealing strips cannot be accidentally pushed away during mounting of the gypsum boards, is achieved by making the width of the middle region of the joint-sealing tape somewhat narrower than the width of the web of the channel profile.

The carrier preferably has three regions. The sealing strips are disposed on two of the regions. These form the two outer regions. The third region is that between the two outer regions. It forms the middle region. The parts of the two outer regions of the carrier on which the sealing strips are not firmly joined to the carrier respectively adjoin the middle region of the carrier and together therewith form a support region of the carrier for application on a building part.

To ensure that the sealing strips, after installation of the joint-sealing tape, reliably seal the joint left during mounting of the gypsum boards and are able to even out any irregularities that may be present in the ceiling, the sealing strips must extend beyond the web of the channel profile on both sides after the joint-sealing tape has been disposed on the profile. This will be achieved by choosing the width of the support region such that it corresponds at least to the width of the web of the channel profile. Furthermore, the spacing of the two sealing strips must be smaller than the width of the web of the channel profile. Thus the sealing strips are able to pivot downward laterally and be applied on the flange of the channel profile, in order thereby to wrap around the channel profile. In this case, the carrier is disposed directly on the web of the channel profile, so that this is positioned between the profile and the ceiling after the profile has been fastened to the ceiling. The narrow sides, facing one another, of the sealing strips become upright when the joint-sealing tape is applied on the channel profile and, after the joint-sealing tape has been firmly applied on the channel profile, extend beyond the face of the web.

Now, during fastening of the channel profile to the ceiling, the projecting length presses firmly against it, whereby irregularities in the ceiling can be evened out. Furthermore, it is achieved by the projecting length that the sealing strips are pressed downward in the direction of the side cheeks of the profile during fastening of the profile, and are applied sealingly on it. On the one hand, therefore, neat centering of the joint-sealing tape on the profile is achieved, and additional fastening of the joint-sealing tape on the profile, especially on the side cheeks of the profile, in order to prevent the joint-sealing tape from detaching or pivoting upward during mounting of the gypsum boards, is unnecessary.

To create a sealing arrangement as described in detail hereinabove, the joint-sealing tape, before the second building part is attached to the first building part, is positioned on the face (F2) of the second building part and together therewith is disposed on the first building part, especially abuttingly.

In one option for sealing a connecting joint in dry construction, the joint-sealing tape, prior to attachment of the profile to the connecting building parts, such as a ceiling, for example, is positioned on a channel profile and then fastened together therewith on the ceiling. In a further operation, the gypsum boards, whether they have one or two layers, are pressed at the end face against the sealing element, so that, in the case of a double-boarded arrangement, the two gypsum boards come into contact via respectively their top edge with the sealing element, especially with the sealing strip, and thereby sealing of the joint is achieved. In order to permit movement of the gypsum board(s) without the formation of a gap between the sealing element and the gypsum board or the gypsum boards in the case of maximum movement, the sealing element must be compressed during mounting of the gypsum board(s).

For this purpose, the material and the thickness of the sealing element are respectively chosen such that the sealing element does not hinder the movement of the gypsum board(s) and, at maximum joint width, the top edge of the gypsum board(s) still remains in contact with the sealing element, in order to ensure adequate sealing against gases. The width of the sealing element is preferably chosen such that it corresponds approximately to twice the width of one gypsum board. It has been found that sufficient sealing may also be achieved when the width of the sealing element corresponds to the width of only one gypsum board.

Alternatively, when only one gypsum board is used, it may be mounted not from underneath in a manner abutting the sealing element, but instead in such a way that the gypsum board partly overlaps the sealing element. Thereby the gypsum board partly overlaps the sealing element, and the overlapping part of the sealing element is pressed between the channel profile and the gypsum board. It has been found that sufficient sealing can also be achieved hereby, especially against gases. To improve the imperviousness and/or the sliding properties, the sealing tape may be laminated on one side with a layer of material, such as a plastic film, for example, that neither hinders the movement of the gypsum board nor is destroyed by it. As an example, the positioning marking for the gypsum board may be easily applied on a film.

In this type of mounting, a large capacity for absorbing movement relative to the joint width is possible. Furthermore, this type is more mounting-friendly than the aforementioned single-boarded or double-boarded arrangement, since the gypsum board can be mounted simply on the sealing element without the need to measure the spacing. If positioning marking is used, the gypsum board can be mounted without measurement of the spacing. Above and beyond this, there is no need to use readily compressible materials for the sealing elements in this type of mounting, thus permitting relatively broad discretion in the choice of material.

In a further particularly preferred alternative, sealing of the joint can be achieved when, in the case of a double-boarded arrangement, the two gypsum boards are mounted with a horizontal offset in such a way that the outer of the two gypsum boards (also referred to as the outer, second gypsum board) is mounted higher (i.e. closer to the ceiling) than the inner gypsum board (also referred to as the inner, first gypsum board). In this embodiment, the thickness of the sealing element is chosen to correspond to the thickness of one gypsum board. The first, inner gypsum board is mounted in such a way that its top edge contacts the end faces of the sealing element, in which case zero or little precompression of the sealing element is necessary. The second, outer gypsum board is attached at a horizontal offset, i.e. it is mounted higher than the first, inner gypsum board, so that it partly overlaps the sealing element. In this case the sealing element and the gypsum board should bear sealingly on one another, in order to seal the gap between the outer, second gypsum board and the sealing element, especially against gases. Thus sealing is achieved between sealing element and the second building part, such as a ceiling, a wall or a floor, as well as between sealing element and outer, second gypsum board.

An empty gap remains between the second building part, such as a ceiling, a wall or a floor, and the outer, second gypsum board. In the case of a vertical movement of the second building part or of the gypsum boards, this gap is completely available to absorb movement.

Depending on how far the outer, second gypsum board overlaps the sealing element (size of the offset), a movement in the other direction may also be absorbed. In this case, it is important that an overlap is still ensured between the second gypsum board and the sealing element. Preferably, therefore, the dimension of the sealing element is chosen such that its thickness is somewhat larger than the thickness of one gypsum board and its height comprises somewhat more than the maximum permissible movement of the building parts (maximum joint width).

By the fact that the thickness of the sealing element is larger than the thickness of the gypsum board, the gypsum board is pushed against the sealing element and somewhat compressed while it is being mounted, whereby the gap between sealing element and gypsum board is reliably sealed, especially against gases.

For easier adjustment of the correct joint dimension in the outer, second gypsum board, markings referred to as positioning marking may be made laterally on the joint-sealing tape. To improve the imperviousness and/or the sliding properties, the sealing tape may be laminated on one side with a layer of material, such as a plastic film, for example, that neither hinders the movement of the gypsum board nor is destroyed by it. As an example, the positioning marking for the outer, second gypsum board may be easily applied on a film.

In this type of mounting, a maximum capacity for absorbing movement relative to the joint width is possible. Furthermore, this type is very mounting-friendly, since firstly the first gypsum board can be mounted simply on contact with the sealing element without the need to measure the spacing. Secondly, especially if positioning marking is used, the second gypsum board can also be mounted without measurement of the spacing. Above and beyond this, the broadest possible discretion in the choice of material for the sealing elements is achieved by this type of mounting, since these are compressed only slightly and thus only slight requirements are imposed on the compressibility of the sealing element.

Without restricting the scope of protection of the invention, the invention will be described in more detail on the basis of a special embodiment of the joint-sealing tape. In this embodiment, the joint-sealing tape is applied to the connecting joints in drywalls. For simplicity, the application to the connecting joint between a ceiling profile, a gypsum board and a ceiling will be described. This ceiling profile is a standard channel profile with a web as well as two flanges. It is clear to the person skilled in the art that the sealing tape may also be applied to connecting joints of other types, regardless of the shape of the sealing elements, if they correspond in terms of their geometry to the connecting joint described here.

Further advantages and features will become obvious from the description hereinafter in conjunction with the attached drawings, wherein.

Figure 3A:
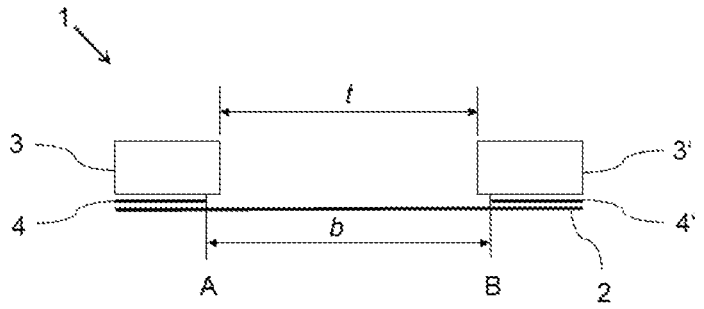
Figure 3B:
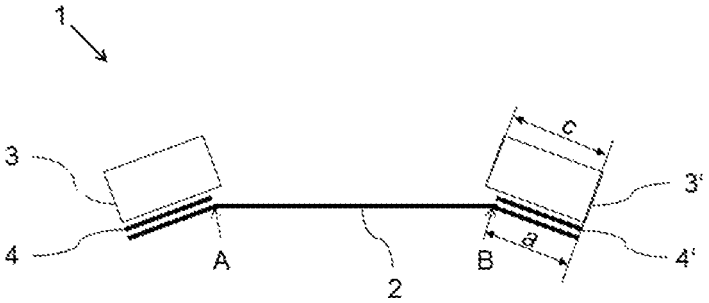
Figure 3C:
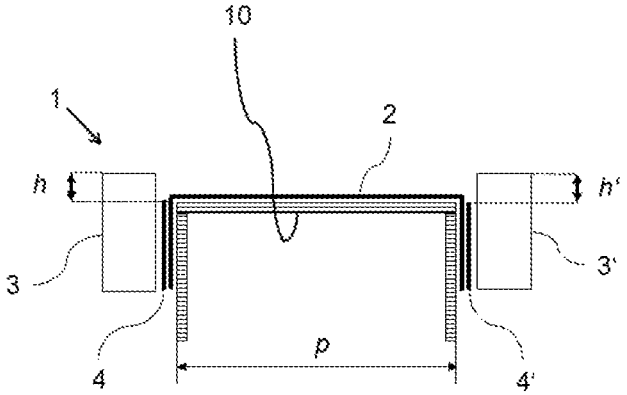
Figure 4:
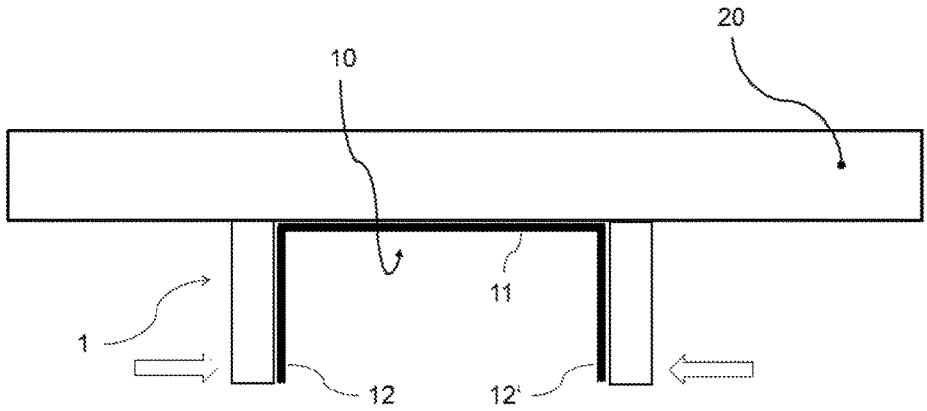
Figure 5:
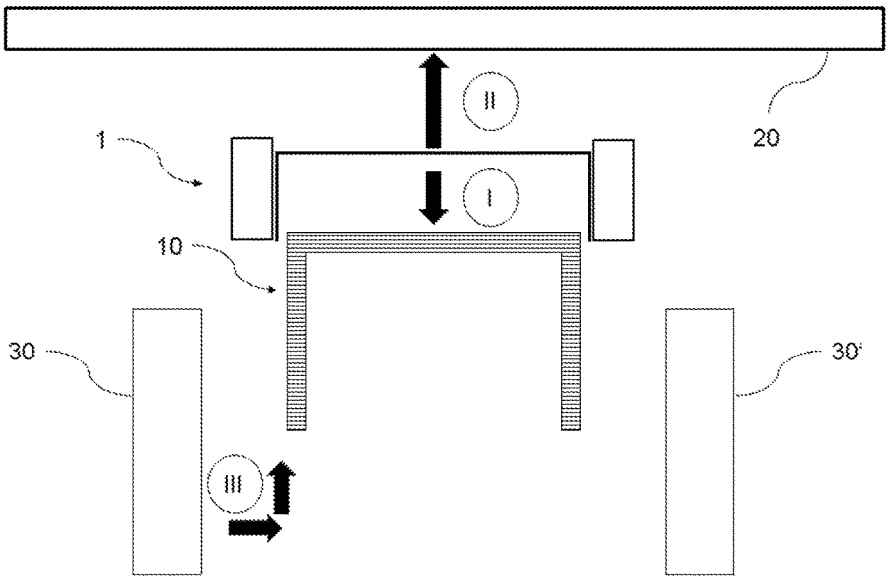
Figure 6:
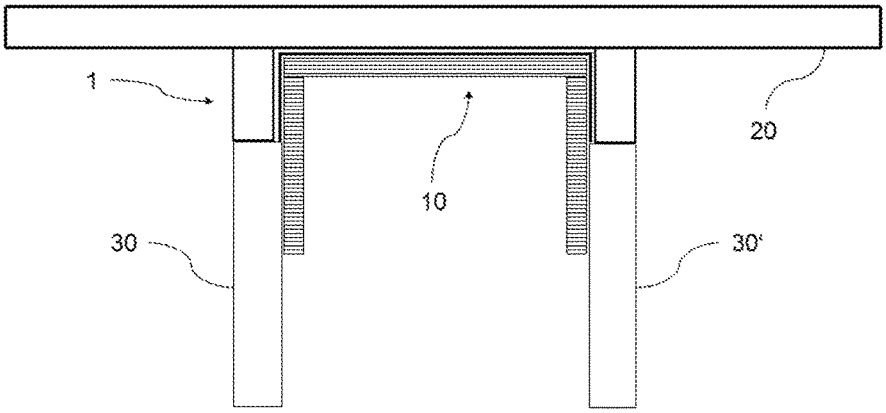
Figure 7:
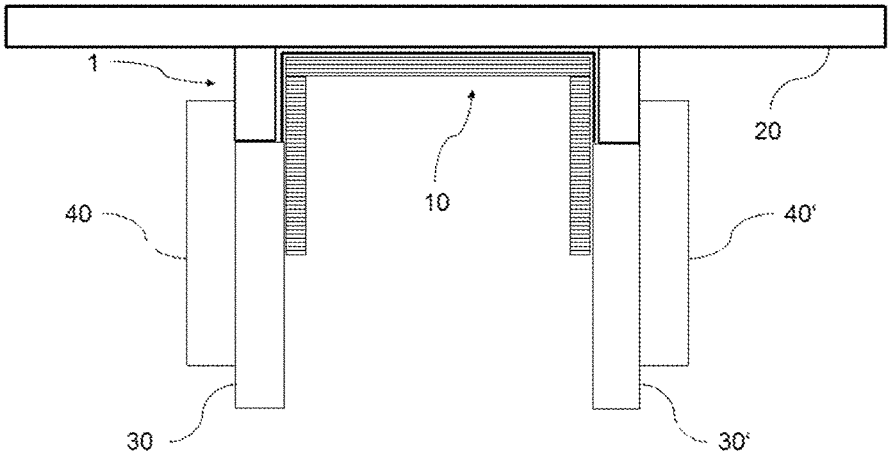
Figure 8:
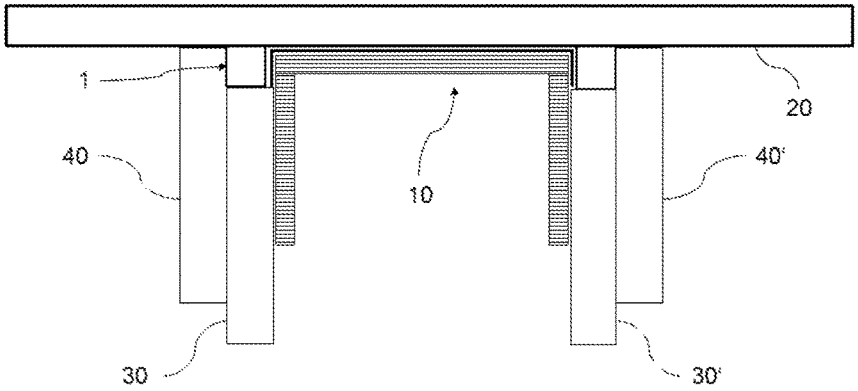
Figure 9:
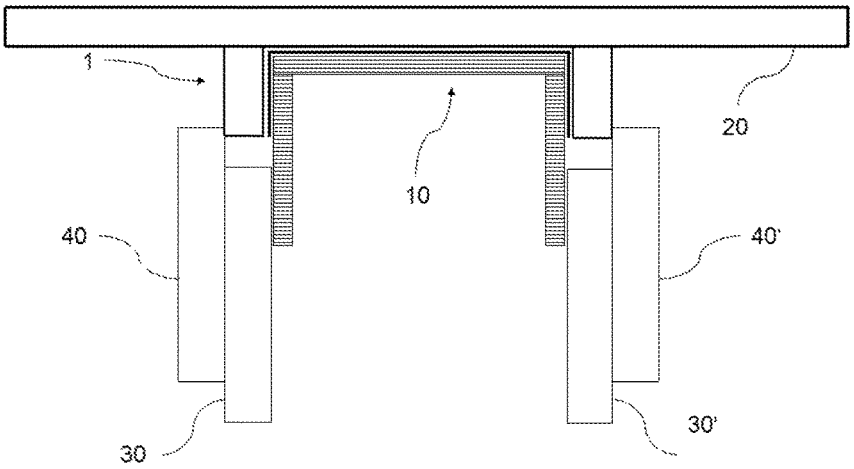
Figure 10:
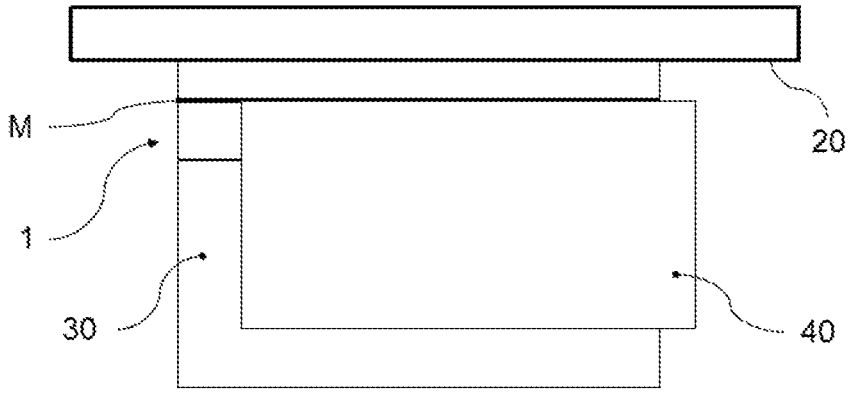

FIGS. 3*a* to 3*c* show a sketched front view of a joint-sealing tape with a rectangular sealing strip as sealing element according to one embodiment of the present invention;

FIG. 4 shows a sketched front view of a building element from a dry-construction profile and a ceiling with the joint-sealing tape shown in FIGS. 3*a* to 3*c* according to one embodiment of an inventive sealing arrangement;

FIG. 5 shows the stepwise procedure for establishing a sealing arrangement according to FIG. 4;

FIG. 6 shows a sketched front view of a finished building element with the embodiment of an inventive sealing arrangement shown in FIG. 4;

FIGS. 7-9 respectively show a sketched front view of a finished building element according to a further embodiment of an inventive sealing arrangement; and FIG. 10 shows a sketched side view of the building element from FIG. 7.

Figure 1:
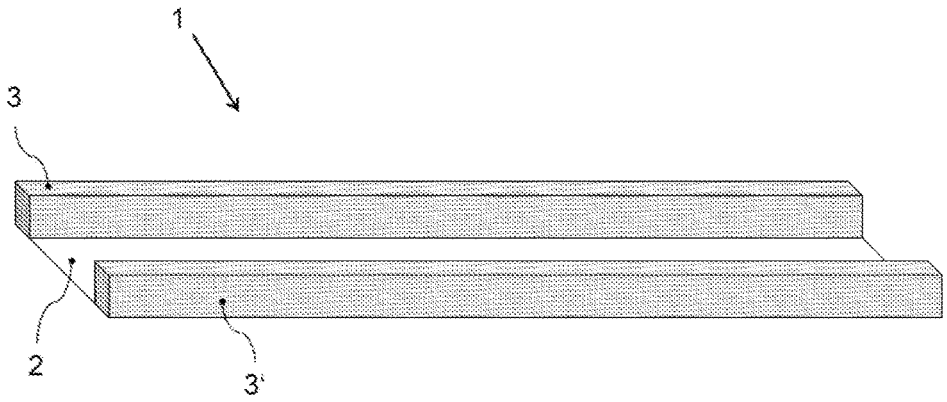
FIG. 1 shows a perspective view of a joint-sealing tape with a rectangular strip as sealing element according to one embodiment of the present invention.
Figure 2:
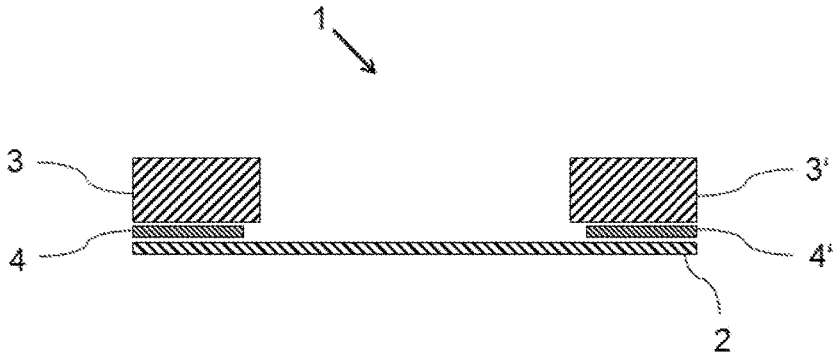
FIG. 2 shows a cross section through a joint-sealing tape with a rectangular strip as sealing element according to one embodiment of the present invention.

A joint-sealing tape 1 according to one embodiment of the invention is shown in FIGS. 1, 2 and 3*a*. Joint-sealing tape 1 has two sealing elements 3, 3', which are formed as strips (hereinafter referred to as sealing strips 3, 3') and are disposed on the outer rims of carrier 2. Sealing strips 3, 3' have a rectangular cross section with two opposite broad sides and respectively two narrow sides running transversely relative to the broad sides and connecting them. As an example, sealing strips 3, 3' consist of a compressible foam and carrier 2 of a plastic film. With one broad side, sealing strips 3, 3' are joined via a respective adhesive layer 4, 4' to the carrier. The distance t between the two sealing strips 3, 3' corresponds to the distance between the two narrow sides facing one another. However, the sealing strips are firmly attached to carrier 2 only on the outer region of the corresponding broad side, so that the respective adhesive layer 4, 4' extends from the rim of carrier 2 to points A and B respectively.

Thus joint-sealing tape 1 is subdivided functionally into three regions, the two outer regions with width c, which correspond to the region in which sealing strips 2 are disposed on carrier 2, and the middle region between them with width t, in which region no sealing material is associated with carrier 2. Sealing strips 3, 3' are each subdivided into two regions, namely each has an outer region, which corresponds to the region that is firmly joined to carrier 2, and each has an inner region, which corresponds to the region that is not joined firmly to carrier 2. These two inner regions face one another. In the illustrated embodiment, the outer region and the inner region of a sealing strip are not separated from one another, and so the sealing strip is formed in one piece. In alternative embodiments, not shown here, the outer region and the inner region of a sealing strip may define separate regions of the sealing strip, which have different cross sections and/or may consist of different materials.

The region of carrier 2 defined by the region between points A and B corresponds to the support region with width b, which is larger than the distance t between the two sealing strips 3, 3' (see FIG. 3*b*). The region on which sealing strips 3, 3' are joined firmly to carrier 2 via adhesive layer 4, 4' has respectively the width a (see FIG. 3*b*).

When joint-sealing tape 1 with the support region is applied on the channel profile of a drywall studwork (not illustrated in the figure), for example, more accurately when it is laid on the web of the channel profile, joint-sealing tape 1 is able to be kinked at points A and B (FIG. 3*b*), in order to be applied closely on the channel profile, as shown in FIG. 3*c*.

FIG. 3*c* shows the condition in which joint-sealing tape 1 is applied completely on channel profile 10, in which case the two sealing strips 3, 3' bear laterally on channel profile 10 and carrier 2 is supported directly on channel profile 10. For joint-sealing tape 1, the width of the support region was chosen to correspond to the width p of the web of the channel profile. As is evident from FIG. 3*c*, a region of sealing strips 3, 3' that extends beyond the face of channel profile 10—projecting length h—is obtained by application of sealing strips 3, 3' on the side cheeks of profile 10.

This projecting length has two functions. Firstly it ensures that sealing strips 3, 3' are pressed in centered manner and firmly on the flanges of channel profile 10 during fastening of channel profile 10 to ceiling 20. This is indicated in FIG. 4 by the two arrows. Thereby additional fastening of sealing strip 3, 3' to flanges 12, 12' of channel profile 10 can be dispensed with, without detriment to the sealing effect under them. Secondly, sealing strips 3 and 3' are pressed firmly on ceiling 20 and thus they are able to even out any irregularities that may be present in ceiling 20 and to seal the gap between channel profile 10 and ceiling 20 from the outside. In this way it is achieved that joint-sealing tape 1 is applied sealingly on ceiling 20 and channel profile 10.

The use of joint-sealing tape 1 for sealing the gap between a ceiling 20, channel profile 10 of a drywall studwork and gypsum board 30 is sketched stepwise in FIG. 5. Firstly, in first step I, joint-sealing tape 1 is laid on the web of channel profile 10 and, in second step II, is fastened together therewith on ceiling 20 in standard manner, e.g. by screws or nails. Then, in a last step III, gypsum boards 30 are applied on the flange of channel profile 20 and pushed upward in the direction of ceiling 20, whereupon a gap remains between the top edge of gypsum board 30 and ceiling 20, which is filled with sealing strips 3, 3' of joint-sealing tape 1, in order to permit vertical movement, for example, of gypsum board 30. Thereby the sealing strips are compressed and thus seal the gap between ceiling 20 and channel profile 10 and the gap between ceiling 20 and gypsum board 30. The finished structure is shown in FIG. 6.

FIG. 7 shows the finished structure of a building element with offset double-boarded arrangement. Firstly, in the first step, joint-sealing tape 1 is laid on the web of channel profile 10 and, in the second step, is fastened together therewith on ceiling 20 in standard manner, e.g. by screws or nails. Then, in a further step, the first, inner gypsum boards 30, 30' are applied on the flange of the channel profile and pushed upward in the direction of ceiling 20, whereupon a gap remains between the top edge of gypsum board 30 and ceiling 20, which is filled with the sealing strips of joint-sealing tape 1, in order to permit vertical movement, for example, of gypsum boards 30, 30'. Gypsum boards 30, 30' are mounted in such a way that the two sealing strips are compressed only slightly. Hereby, at maximum joint width, a gap is able to form between the sealing strips of joint-sealing tape 1 and gypsum boards 30, 30'. The second, outer gypsum boards 40, 40' are mounted from outside on the two first, inner gypsum boards 30, 30', generally by joining the two boards 30, 40, 30', 40' supported on one another by screws, in which case the two second, outer gypsum boards 40, 40' are mounted somewhat higher than the two first, inner gypsum boards 30, 30', so that they partly overlap the sealing strips of joint-sealing tape 1. Thereby a gap is formed between the top edge of the second, outer gypsum boards 40, 40' and ceiling 20, which permits movement of gypsum boards 30, 30', 40, 40' upward in the direction of ceiling 20. Preferably the sealing strips are positioned somewhat higher than the first, inner gypsum boards 30, 30', so that they protrude somewhat after mounting of the first, inner gypsum boards 30, 30'. This projecting length is compressed by the second, outer gypsum boards 40, 40', with the result that, on the one hand, very good sealing of the second, outer gypsum boards relative to the sealing strips of joint-sealing tape 1 is achieved and, on the other hand, sealing of the gap formed between the sealing strips of joint-sealing tape 1 and the first, inner gypsum boards 30, 30' in the case of the maximum joint width is achieved.

A marking line M on the face pointing outward after mounting of joint-sealing tape 1, i.e. from the face of the sealing strip pointing away from the flange of channel profile 10 (FIG. 10), facilitates mounting of the second, outer gypsum boards at the correct height. Marking M takes into consideration the maximum movement of the second, outer gypsum boards 40, 40' upward in the direction of ceiling 20 (FIG. 8). Furthermore, marking line M takes into consideration the maximum movement of the two first, inner gypsum boards 30, 30' downward and away from ceiling 20 (FIG. 9), so that sealing is ensured at all times in both directions of movement (FIGS. 8, 9).

As is obvious from the examples, application is very mounting-friendly, since no additional fastening of the joint-sealing tape, for example to the profile or to the ceiling, is necessary. Accurately fitting application of the joint-sealing tape, for example against a profile, is also unnecessary, by virtue of the self-centering of the joint-sealing tape during mounting of the profile on a building part. Mounting is therefore conceivably easy, and the working effort for mounting the joint-sealing tape is greatly reduced.

Regardless of the pressure exerted by the gypsum board, well-defined pressing of the sealing strips against the underlying surface is achieved by the inventive configuration of the joint-sealing tape, and undesired upward pivoting is prevented by the firm pressing of the sealing strips on the profile. Via the choice of the material from which the sealing strips are made, a well-defined spacing can be easily adjusted between a gypsum board and the underlying surface on which the profile is mounted. Furthermore, when used in an expansion joint, the sealing strips hinder movement much less than compared with the known sealing solutions, so that it is possible to work with only a relatively small joint width in order to achieve adequate absorption of movement.

The invention therefore achieves safe and reliable sealing of joints between two building parts, especially between a profile of a drywall studwork and a building part adjacent thereto, such as, for example, a ceiling, wall or floor. In this connection, two-sided sealing can be achieved in only one operation, by providing a prefabricated sealing element.

The invention claimed is:

1. A joint-sealing tape for sealing a joint between a first building part and a second building part, said joint-sealing tape comprising:

an elongated carrier, and at least two separate sealing elements of predetermined width (c), which are disposed on one side of the carrier, spaced apart, side-by-side and running in a longitudinal direction of the carrier, and which each have two oppositely disposed broad sides as well as two narrow sides running transversely relative to the broad sides and connecting them, wherein the sealing elements are disposed with one broad side on the carrier, wherein the sealing elements are each joined firmly to the carrier only at respective outer rim regions of said joint-sealing tape and only via part of their broad side.

2. The joint-sealing tape according to claim 1, wherein the sealing elements are disposed in such a way on the carrier that parts of the sealing elements that are joined firmly to the carrier respectively form an outer region, and parts that are not joined firmly to the carrier form an inner region, wherein the inner regions face one another.

3. The joint-sealing tape according to claim 2, wherein the carrier has three regions, two regions on which the sealing elements are disposed, which form the two outer regions, and one region between, which forms the middle region, wherein parts of the two outer regions of the carrier, on which the sealing elements are not firmly joined to the carrier, respectively adjoin the middle region of the carrier and together therewith form a support region for application on a building part.

4. The sealing arrangement according to claim 3, wherein the width of said middle region is broader than a distance between inner lateral sides of said sealing elements.

5. The joint-sealing tape according to claim 1, wherein the sealing elements consist of a deformable material.

6. The joint-sealing tape according to claim 5, wherein the sealing elements consist of an intumescent material.

7. The joint-sealing tape according to claim 5, wherein the sealing elements consist of one piece made from one material or of multiple parts made from several materials and exist as a layered body.

8. The joint-sealing tape according to claim 1 wherein the carrier consists of a plastic film, of a fabric, or of a nonwoven.

9. A sealing arrangement for sealing a joint between two juxtaposed building parts, the sealing arrangement comprising:

at least one first building part, one second building part and a joint-sealing tape according to claim 1, wherein the side with which the second building part bears on the first building part has a face (F2) with a width (B2; p) and the first building part has a face (F1) with a width (B1), on which the second building part bears, with the condition that the width (B2; p) is smaller than the width (B1), wherein the sealing elements are positioned in an outer region of the joint and seal the joint from outside.

10. The sealing arrangement according to claim 9, wherein the sealing elements are disposed laterally on the second building part.

11. The sealing arrangement according to claim 9, wherein the joint-sealing tape is disposed on the second building part in such a way that a side of the carrier disposed opposite the sealing elements comes into contact with the second building part and the narrow sides, facing one another, of the sealing elements respectively come into contact with the first building part.

12. The sealing arrangement according to claim 9, wherein, the sealing elements wrap around and are applied on opposite faces, which are joined by the face (F2), so that the sealing elements have a projecting length (h) relative to the face (F2) of the first building part, wherein the projecting length (h) points in the direction of the face (F1) of the first building part.

13. The sealing arrangement according to claim 12, with a joint-sealing tape, wherein the broad sides of the sealing elements have a predetermined width (c), each outer region of the sealing elements has a width (a) and the support region of the carrier has a width (b), wherein, for given width (c) and given width (B2; p), the width (a) is chosen as a function of the width (B2; p) of the second building part in such a way that the width (b) of the support region of the carrier corresponds to at least the width (p) and the width (t) of the middle region of the joint-sealing tape is smaller than the width (p).

14. The sealing arrangement according to claim 9, wherein the first building part is a wall, a ceiling or a floor of a building structure and the second building part is a frame profile of a drywall studwork.

* * * * *